US008196771B1

(12) United States Patent
Gathings

(10) Patent No.: US 8,196,771 B1
(45) Date of Patent: Jun. 12, 2012

(54) PORTABLE FOOD ORGANIZER

(76) Inventor: Joanne Gathings, Dade City, FL (US)

( * ) Notice: Subject to any disclaimer, the term of this patent is extended or adjusted under 35 U.S.C. 154(b) by 336 days.

(21) Appl. No.: 12/545,973

(22) Filed: Aug. 24, 2009

(51) Int. Cl.
*B65D 1/24* (2006.01)

(52) U.S. Cl. ..... 220/556

(58) Field of Classification Search ..... 220/556, 220/555, 526, 523, 507, 915.2, 915.1; 62/457.7, 62/457.1; D9/761, 757, 756, 760, 759; D7/557, D7/555, 541, 538, 546, 545, 543, 553.1, 553.2, D7/553.3, 706, 705, 701, 703; *B65D 1/24, B65D 1/36*

See application file for complete search history.

(56) References Cited

U.S. PATENT DOCUMENTS

| | | | | | |
|---|---|---|---|---|---|
| 849,165 | A | * | 4/1907 | Schneider | 220/572 |
| 1,389,986 | A | * | 9/1921 | Ristenpart | 206/561 |
| 1,595,356 | A | * | 8/1926 | Moseman | 220/23.8 |
| D170,087 | S | * | 7/1953 | Harper | D9/757 |
| 3,094,264 | A | | 6/1963 | Petrone | |
| 3,205,033 | A | * | 9/1965 | Stentz | 312/236 |
| 4,067,559 | A | * | 1/1978 | McGann, Jr. | 269/13 |
| 4,440,303 | A | * | 4/1984 | Seager | 206/509 |
| 4,574,174 | A | * | 3/1986 | McGonigle | 219/735 |
| 4,887,790 | A | * | 12/1989 | Wilkinson et al. | 249/52 |
| 4,911,296 | A | * | 3/1990 | Hart, Jr. | 206/373 |
| 5,027,972 | A | * | 7/1991 | Bartholomew | 220/526 |
| 5,373,708 | A | * | 12/1994 | Dumoulin, Jr. | 62/457.7 |
| 5,437,165 | A | | 8/1995 | White et al. | |
| D369,469 | S | * | 5/1996 | Gregory | D3/319 |
| D396,956 | S | * | 8/1998 | Iversen et al. | D3/313 |
| 5,864,981 | A | * | 2/1999 | Zeman | 43/54.1 |
| 5,890,613 | A | * | 4/1999 | Williams | 220/23.4 |
| 6,153,857 | A | | 11/2000 | Gunnels | |
| 7,249,686 | B1 | * | 7/2007 | Aesquivel | 220/556 |
| 2007/0284358 | A1 | * | 12/2007 | Claffy | 219/386 |

FOREIGN PATENT DOCUMENTS

JP 2006288334 A * 10/2006

* cited by examiner

*Primary Examiner* — Mickey Yu
*Assistant Examiner* — Robert J Hicks
(74) *Attorney, Agent, or Firm* — Ronald E. Smith; Courtney M. Dunn; Smith & Hopen, P.A.

(57) ABSTRACT

A portable organizer for a food product, such as hot dogs or sausages, related food items such as buns, and related utensil and condiments, that is compact and easily carried. The organizer comprises a base and a lid, the base having a plurality of rows of compartments for food products and condiments. The organizer also has drawers for storing utensils. The organizer is of an appropriate size and made of an appropriate material to be stored in a cooler and may also have wheels and be used as a rolling serving tray.

9 Claims, 4 Drawing Sheets

PORTABLE FOOD ORGANIZER

DESCRIPTION OF THE INVENTION

1. Field of Invention

This invention relates to a portable organizer for a food product and related utensils and condiments that is capable of being stored in a cooler and also used as a rolling serving tray.

2. Background of the Invention

Many outdoor activities, such as boating, camping, and picnicking involve the transportation of food items, along with related condiments, and the utensils needed to dispense the condiments and aid in consumption of the food items. For example, hot dogs and sausages, two food products popular for such outdoor activities, require related food products, such as buns, condiments such as ketchup, mustard, relish, and sauerkraut, and utensils such as plates, napkins, spoons, forks, and knives. Loading and transporting the various containers and accessories necessary to transport such meals is burdensome, laborious, and inconvenient.

SUMMARY OF INVENTION

Accordingly, it is an object of the present invention to provide a portable organizer for a food product, such as hot dogs or sausages, related food items such as hot dog buns, and related utensil and condiments that is compact and easily carried. It is a further object of the present invention to provide a portable food organizer capable of being stored in a cooler and also used as a rolling serving tray.

The novel portable food organizer includes a substantially rectangular base having a front wall, a rear wall, and two side walls mounted about the periphery of the base in upstanding relation thereto. Two arrays of elongated, concave components and an array of compartments are formed in the hollow interior of the organizer. Each of the arrays extend between the two side walls and the first array of components also extends from the rear wall.

In a preferred embodiment, the array of compartments extends from the front wall and the second array of components is located between and adjacent to both the first array of components and the array of compartments.

In an additional embodiment, the second array of components extends from the front wall and the array of compartments is located between and adjacent to both the first array of components and the second array of components.

Each of the components in the second array of components may be removable trays. Additionally, the novel food organizer may further include drawers located within the rectangular base extending through openings in at least one of the two side walls. The portable food organizer may further include a substantially rectangular lid. The portable food organizer may also include four wheels, each wheel located at a corner of the rectangular base.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
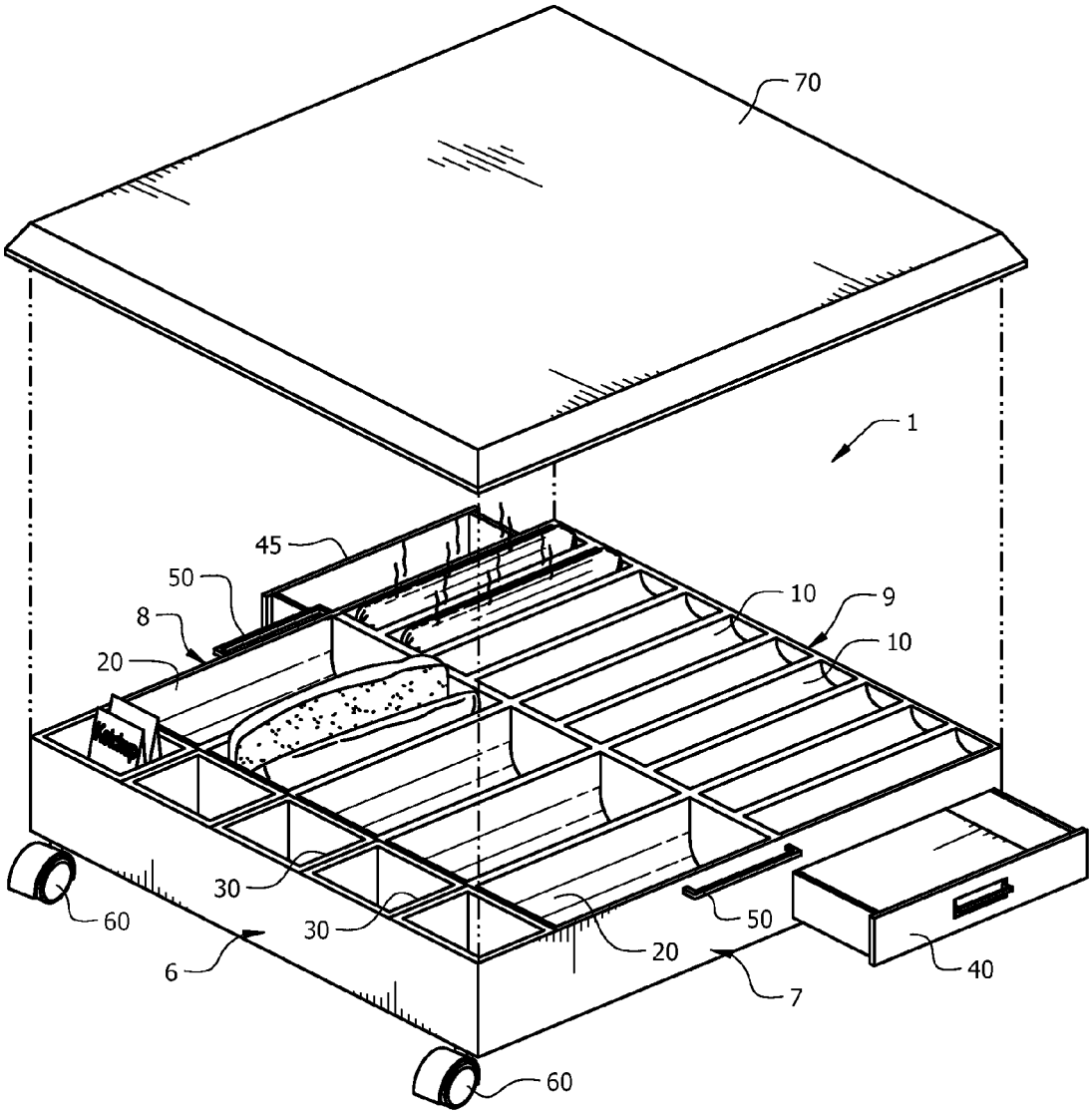
FIG. 1 is a perspective view of a portable food organizer according to an embodiment of the present invention
Figure 2:
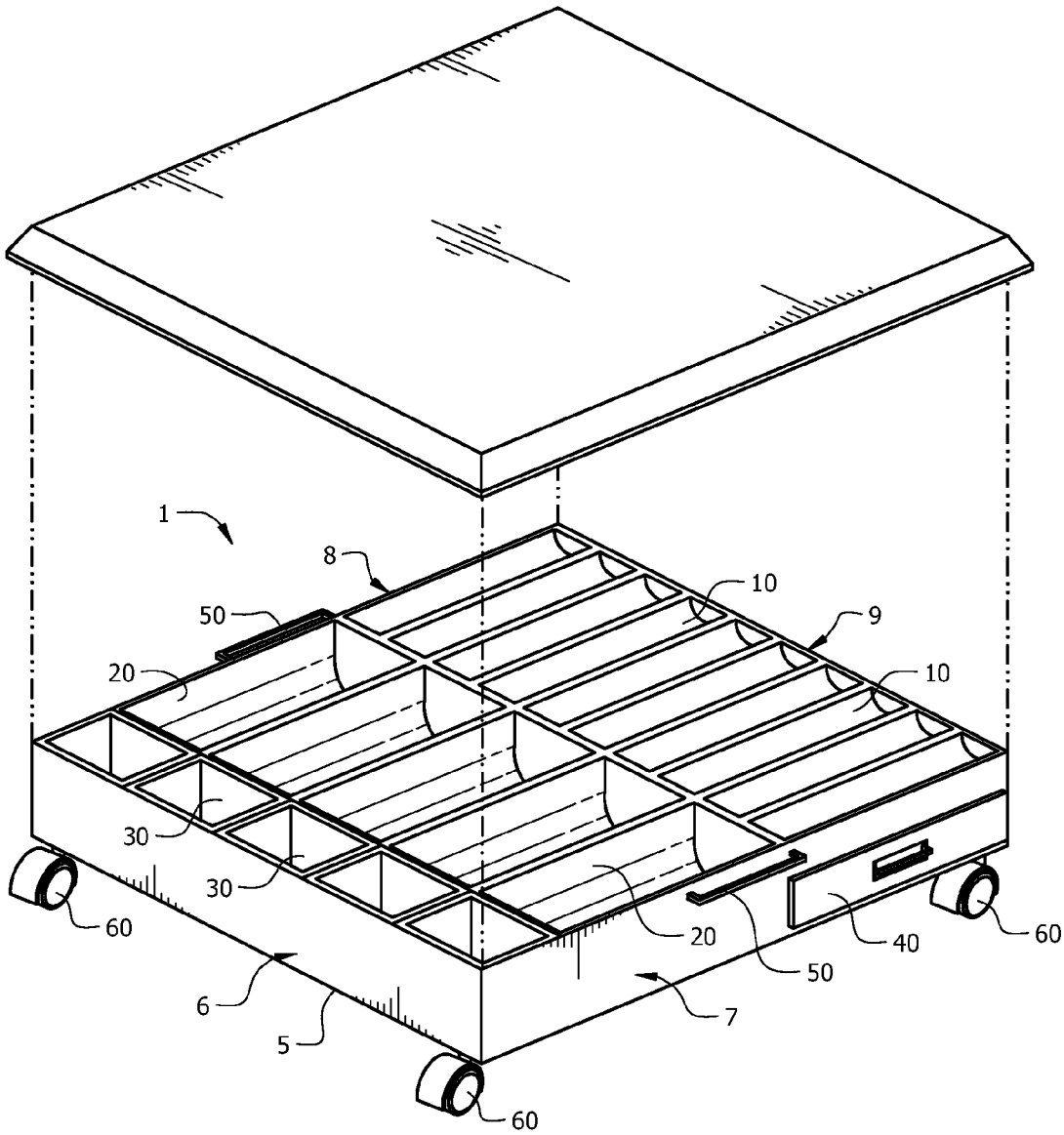
FIG. 2 is a perspective view of a portable food organizer according to an embodiment of the present invention.
Figure 3:
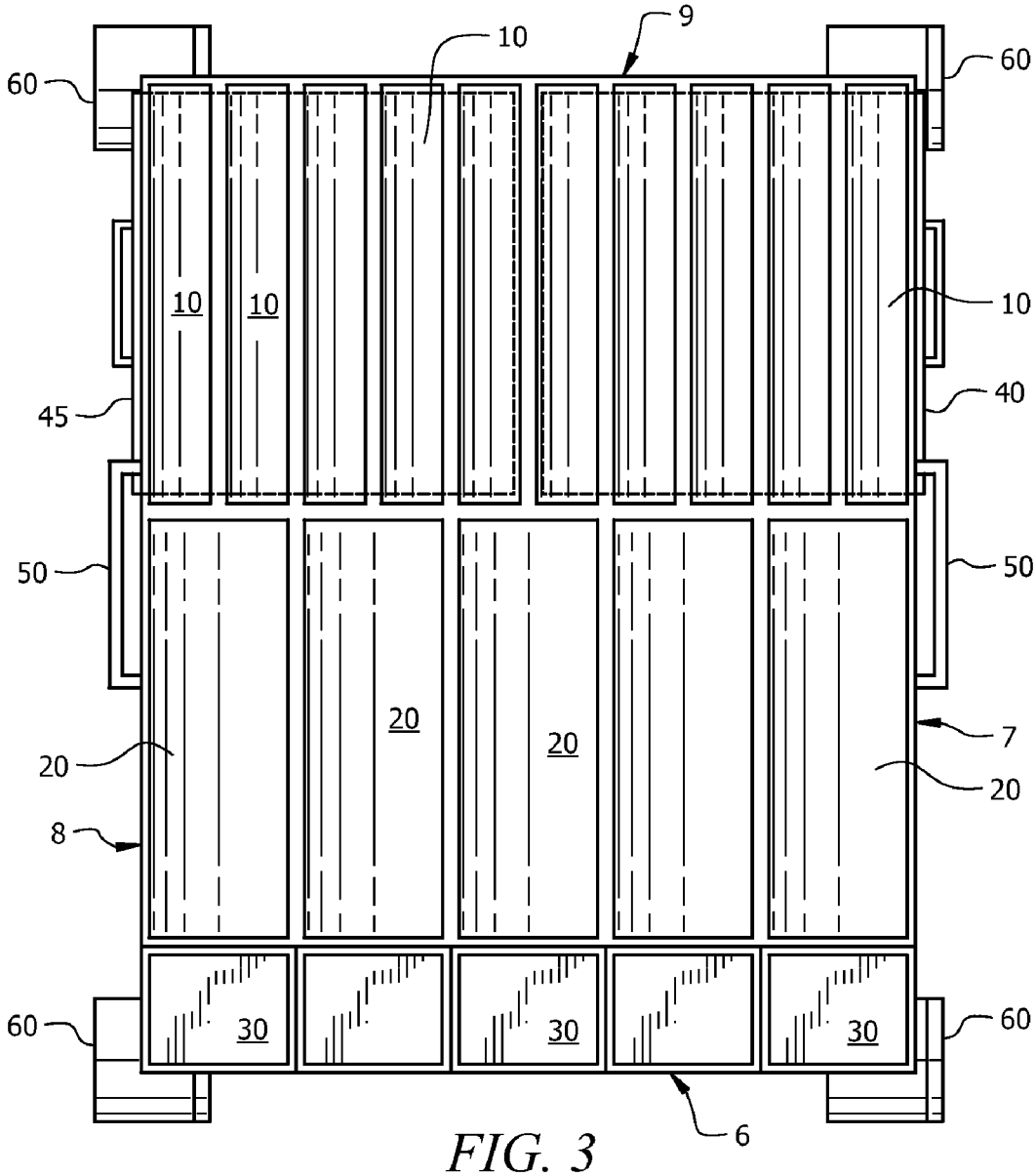
FIG. 3 is a top plan view of a portable food organizer with the lid removed according to an embodiment of the present invention.

Referring first to FIGS. 1 through 3, the novel portable food, condiment, and utensil organizer is referred to as a whole by the reference numeral 1. Organizer 1 includes substantially rectangular base 5 having a substantially horizontal bottom (not shown) and four upwardly projecting, vertically disposed walls—front wall 6, real wall 9, and two opposing side walls 7, 8—mounted about the perimeter of base 5. Said vertically disposed walls have a common height. First array of elongated, concave components 10 extends between opposing side walls 7, 8. The elongated and concave shape of first array of components 10 are adapted to effectively support a hot dog, sausage, or other food product of similar shape. The height or depth of each component of said first array of components is less than the common height of the front wall, rear wall, first side wall and second side wall so that at least one drawer may be positioned beneath said first array of components as depicted. Second array of elongated, concave components 20 also extends between opposing side walls 7, 8. The depth of the components of second array 20 is greater than the depth of the components of first array 10 as depicted. The depth of the components of second array 20 is substantially equal to the common height of the front wall, rear wall, first side wall and second side wall as depicted. The elongated and concave shape of second array of components 20 are adapted to effectively support a bun. Array of compartments 30 also extends between opposing side walls 7, 8. The shape of each of the compartment in array of compartments 30 is adapted to effectively support condiments, such as ketchup, mustard, relish, and sauerkraut. Such condiments may be individually packaged, as shown in FIG. 1, or deposited directly into the compartments. The depth of each compartment 30 is substantially equal to the depth of each component in second array of components 20 but said depth could be decreased to that of the components of first array of components 10 if it is desired to add a drawer of drawers beneath said compartments 30.

Organizer 1 in the depicted embodiment further includes drawers 40, 45 located beneath first array 10. Said drawers may be used for housing utensils, such as forks, knives, spoons, and napkins. A drawer or drawers may be positioned beneath second array of components 20 only if said second array 20 has a decreased depth and a drawer or drawers may be positioned beneath said array of compartments 30 only if said array of compartments 30 has a decreased depth.

In an embodiment, as shown in FIGS. 1 through 3, first array of components 10 extends from rear wall 9 and is located adjacent to second array of components 20 and second array of components 20 is adjacent to array of compartments 30, which extends from front wall 6. Other configurations are also within the scope of this invention. For example, second array of components 20 may extend from rear wall 7 and adjacent to first array of components 10 and first array of components 10 may also be adjacent to array of compartments 30, which extends from front wall 6. As another example, array of components 30 may be located between first array of components 10 and second array of components 20. These examples are not limiting and any arrangement of arrays may be used in organizer 1.

Each of the components in second array of components 20 is a removable tray. These trays serve as individual servers for each completed food product. For example, if the component houses a bun, a hot dog could be placed in the bun and condiments placed thereon. The entire package—hot dog, bun, associated condiments, and removable tray—could then be removed from the organizer, thereby removing the need for a plate.

As further shown in FIGS. 1 through 3, organizer 1 has handles 50 located on the exterior side of opposing side walls 7, 8.

Organizer 1 further includes drawers 40, 45 located beneath one or more of arrays 10, 20, and 30. Drawers may be used for housing utensils, such as forks, knives, spoons, and napkins.

Organizer 1 may also include wheels 60. Wheels 60 may be fixed in the down position or, alternatively, may fold up to provide a more compact structure. In addition, wheels may be fitted into recesses in rectangular base 5. Wheels 60 allow organizer 1 to also function as a rolling serving tray.

Figure 4:
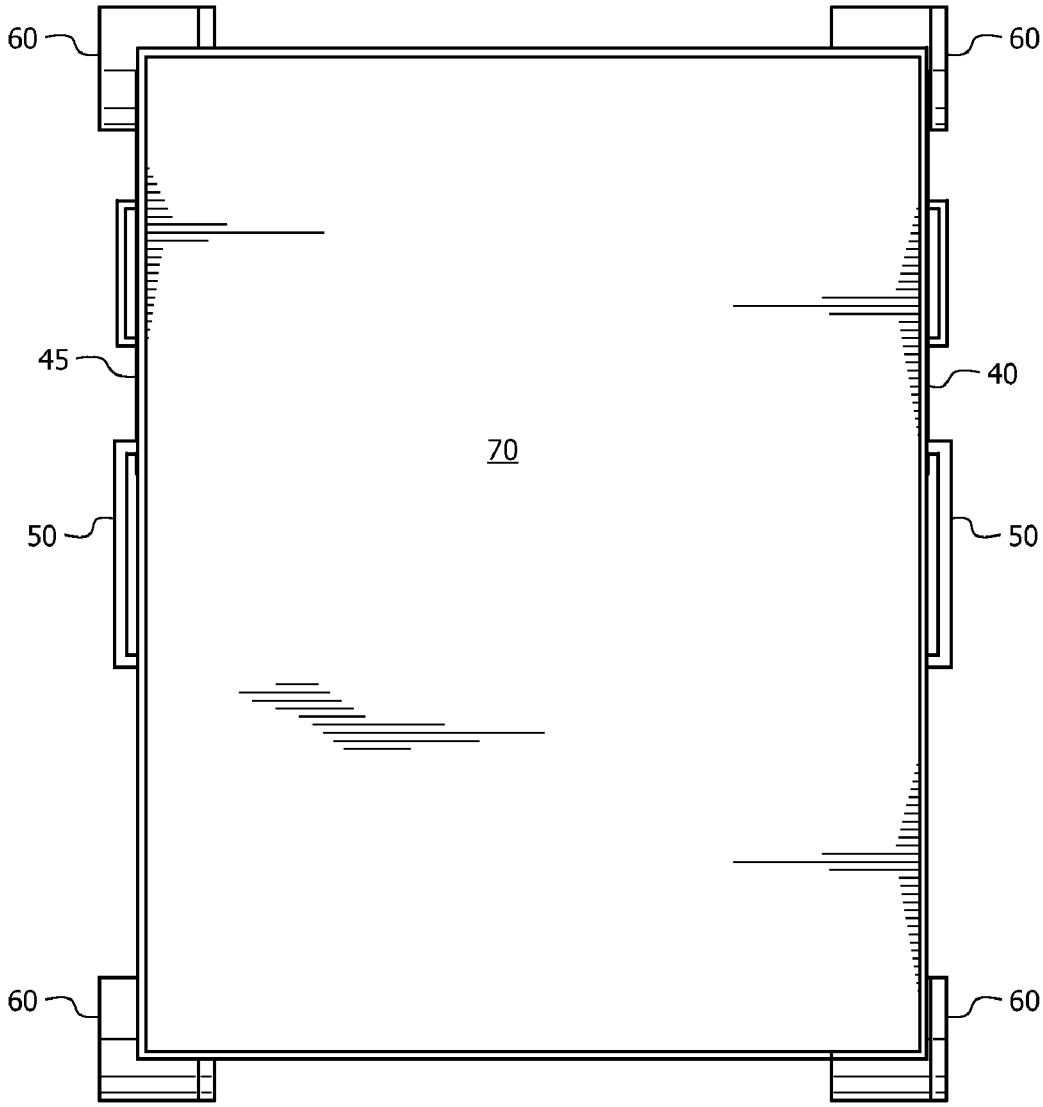
FIG. 4 is a top plan view of a portable food organizer with a lid in place according to an embodiment of the present invention

As shown in FIG. 4, organizer 1 further includes substantially rectangular lid 70. Lid 70 may be a removable lid or lid 70 may be hingedly attached to one of vertical walls 5, 6, 7, 8.

Organizer 1 may be capable of withstanding disparate temperatures such as that experienced when hot food is placed in the organizer, when the organizer is placed on a heated surface or when the organizer is placed in a cooler. Organizer is also of a size capable of fitting into a cooler.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A portable food organizer, comprising:

a substantially rectangular base having a vertically disposed front wall, a vertically disposed rear wall, a vertically disposed first side wall, and a vertically disposed second side wall mounted about a perimeter of said base;

said front wall, rear wall, first side wall and second side wall having a common height;

a first array of elongated, concave components extending between the first side wall and the second side wall;

an array of compartments extending between the first side wall and the second side wall; and a second array of elongated, concave components extending between the first side wall and the second side wall;

each compartment of said array of compartments having a depth substantially equal to a height of said front, rear, first side wall and second side wall;

each component of said second array of components having a depth substantially equal to a height of said front, rear, first side wall and second side wall;

each component of said first array of components having a depth less than a height of said front, rear, first side wall and second side wall;

a drawer formed in at least one of said first side wall and second side walls;

said drawer having a depth less than a height of said front, rear, first side wall and second side wall;

said drawer positioned beneath said first array of components.

2. The portable food organizer of claim 1, further comprising:

each of the components in the second array of components being removable tray.

3. The portable food organizer of claim 1, further comprising:

a substantially rectangular lid having a length substantially equal to a length of said first and second side walls and a width substantially equal to a width of said front and rear walls;

said lid having a height substantially less than said common height of said front wall, rear wall, first side wall and second side wall so that said lid does not substantially increase the height of said portable food organizer.

4. The portable food organizer of claim 1, further comprising:

a wheel located at each corner of the rectangular base.

5. The portable organizer of claim 1, further comprising:

a first drawer formed in said first side wall beneath said first array of components and a second drawer formed in said second side wall beneath said first array of components.

6. The portable organizer of claim 5, further comprising:

a handle mounted to said first drawer to facilitate opening and closing of said first drawer.

7. The portable organizer of claim 5, further comprising:

a handle mounted to said second drawer to facilitate opening and closing of said second drawer.

8. The portable food organizer of claim 1, further comprising:

a handle mounted to said first side wall, mid-length thereof, to facilitate movement of said portable food organizer.

9. The portable food organizer of claim 1, further comprising:

a handle mounted to said second side wall, mid-length thereof, to facilitate movement of said portable food organizer.

* * * * *